United States Patent [19]

Kozuka et al.

[11] 4,160,003

[45] Jul. 3, 1979

[54] METHOD OF MOLDING CEMENTITIOUS MATERIAL

[75] Inventors: Mikio Kozuka, Yokohama; Isao Ono, Kawasaki; Takashi Fukuwatari, Tokyo, all of Japan

[73] Assignee: Asahi Glass Company, Ltd., Tokyo, Japan

[21] Appl. No.: 856,588

[22] Filed: Dec. 1, 1977

Related U.S. Application Data

[63] Continuation of Ser. No. 659,081, Feb. 18, 1976, abandoned.

[30] Foreign Application Priority Data

Feb. 18, 1975 [JP] Japan ..... 50-19429
Feb. 18, 1975 [JP] Japan ..... 50-19430

[51] Int. Cl.[2] ..... B28B 1/26

[52] U.S. Cl. ..... 264/87; 264/226; 264/335; 264/DIG. 78; 264/517

[58] Field of Search ..... 264/87, 91, 101, 220, 264/335, DIG. 78, 226; 164/7, 160

[56] References Cited

U.S. PATENT DOCUMENTS

| | | | |
|---|---|---|---|
| 2,472,754 | 6/1949 | Mead | 264/DIG. 78 |
| 2,513,785 | 7/1950 | Browne | 264/DIG. 78 |
| 2,517,902 | 8/1950 | Luebkeman | 264/DIG. 78 |
| 3,789,907 | 2/1974 | Nakata | 164/7 |
| 3,843,301 | 10/1974 | Hijikata | 425/388 |
| 3,955,266 | 5/1976 | Honami | 264/92 X |

*Primary Examiner*—Thomas P. Pavelko
*Attorney, Agent, or Firm*—Oblon, Fisher, Spivak, McClelland & Maier

[57] ABSTRACT

A method is disclosed of molding a cementitious material within a mold having a filler material bed, the configuration of which is maintained by means of suction applied through a filter disposed within the mold frame. A shield layer can be formed upon a surface of the filler material bed having air permeability so as to impart a desirable shape thereto, and the filler material is fixed under reduced pressure conditions within the mold so as to form a molding mold, whereupon the cementitious material may be charged into the mold so as to set therein. It is also possible to achieve the method of the present invention by charging a cementitious material within a molding mold having a desirable configuration, forming a filler material bed having good air permeability with or without a shield layer disposed upon the cementitious material, and preparing a hardening mold, under reduced pressure conditions, beneath the filler material bed.

11 Claims, 18 Drawing Figures

METHOD OF MOLDING CEMENTITIOUS MATERIAL

This is a continuation, of application Ser. No. 659,081 filed Feb. 18, 1976 now abandoned.

BACKGROUND OF THE INVENTION

1. Field of the Invention:

The present invention relates generally to molding, and more particularly to a method of molding a cemetitious material.

2. Brief Description of the Prior Art:

Heretofore, cementitious material has been shaped by means of a single mold, or an assembly mold. When either one of a single-use mold or a repeated-use mold has been used, characteristic disadvantages, such as, for example, a long operation time for preparing the mold, complex apparatus, and a limitation upon the configuration of the mold, are present. In addition, considerable time is required for completing the hardening operation of the material, and many molds must be used during such time period. There is thus a need to increase the efficiency of the molds, and the uses thereof, and the inventors of the present invention have sought to develop a method of easily molding a cementitious material having complex configurations without the above-mentioned difficulties.

SUMMARY OF THE INVENTION

Accordingly, it is an object of the present invention to provide a method of molding a cementitious material upon a mass production basis with one master model by easily preparing the mold within a short period of time which operation has heretofore been expensive and time consuming.

In the preparation of the mold, a filler material and a frame can be repeatedly used, and even a shield layer can be reused in the case of a thick plastic film. A master model can be prepared from economical material by assembling together the parts thereof, whereby the productivity is excellent within the mass production of a few types, as well as the mass production of many types, of products.

Another object of the present invention is to provide a method of molding a cemetitious material wherein the separation of the product from the mold is easily accomplished by means of a shield layer, surface protection and decoration of the surface of the molded product also being attained as a result of the use of the shield layer.

Still another object of the present invention is to provide a method of molding a cementitious material so as to precisely prepare a complexly configured product without even negligible damage occuring to a weak part, such as, for example, a thin part thereof during the separation operation due to the fact that the filler material has great fluidity and is able to form any one of various shapes.

Yet another object of the present invention is to provide a method of molding a cementitious material by using a molding mold and a hardening mold whereby the molding mold is repeatedly used in a short period of time, and many products can be prepared with a small number of molding molds in a highly efficient manner.

A further object of the present invention is to provide a method of molding a cementitious material which hardens rapidly so as to improve the above-mentioned effects, the term "set" including the setting or hardening of the cementitious material within the mold.

The foregoing and other objects of the present invention are achieved through the provision of a method of molding a cementitious material within a mold having a filler material bed, the configuration of which is maintained by means of suction applied through a filter disposed within the mold frame. A shield layer can be formed upon a surface of the filler material bed having air permeability to impart a desirable shape thereto, and the filler material is fixed under reduced pressure conditions within the mold so as to form a molding mold, whereupon the cementitious material may be charged into the mold so as to set therein. It is also possible to achieve the method of the present invention by charging a cementitious material within a molding mold having a desirable configuration, forming a filler material bed having good air permeability with or without a shield layer disposed upon the cementitious material, and preparing a hardening mold under reduced pressure conditions and beneath the filler material bed.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
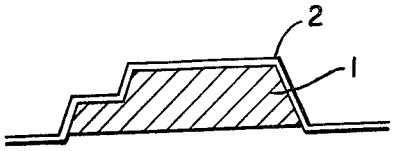
FIGS. 1–4 are cross-sectional views illustrating one embodiment of a method of preparing a mold in accordance with the present invention.

Filler material is charged into a frame, and if the frame is open at one or more surfaces, such areas can be covered with a film and if desirable, a shield layer may be formed by covering the same with a fine powder layer with or without a binder, or alternatively, an air permeable sheet or film. The shield layer comprises layers which have an air permability less than that of the filler material or air impermeable layers, and within the molding mold, it is necessary to form a shield layer. Within the setting or hardening mold, it is not always necessary to form a shield layer, however, when a shield layer is formed, the filler material is firmly fixed or set by means of suction applied through means of a filter. It is thus unnecessary to fix the filler material with a binder as the same may be fixed by means of the suction applied through the filter. In addition, it is also noted that since the binder is not included within the filler material, the filler material can be reused may times.

The cementitious materials utilized within the invention may include a slurry of water and an inorganic material which is settable within water, such as, for example, portland cement, slag cement, alumina cement, Roman cement, natural cement, hydraulic lime, magnesia cement, lime gypsum and mixtures thereof, and the slurry can be admixed with an aggregate, such as, for example, sand, stone, rock or the like, and/or a fibrous reinforcing material, such as, for example, asbestos, chopped glass fiber strands, glass wool, steel wool, carbon fibers, synthetic fibers, or the like and/or an additive, such as, for example, synthetic resin, a blowing agent, and the like. The slurry is molded within a mold or is charged by spraying the same and is set within the mold, the term "set" meaning the setting or hardening of the cementitious material within the mold.

In accordance with the present invention, it is possible to achieve a precise molded product by using the aforenoted type of mold, and accordingly, it is preferable to prepare a small or thin molded product, especially a molded product which is made of a cementitious material reinforced with glass fiber or made of gypsum.

In accordance with the present invention for preparing a hardening mold with a filler material, such as, for example, sand which is fixed under reduced pressure conditions, the molding mold into which the cementitious material is charged, can be made of various materials such as, for example, wood, metal, fiber-reinforced plastic, rubber or a cementitious material and may be a shell type mold. It is preferable to use a mold prepared by charging therein sand, and fixing or setting the sand under reduced pressure conditions, as noted hereinbelow, and it is also possible to use a shield layer for maintaining the configuration of the sand under the reduced pressure conditions. The shield layer can be an air permeable or an impermeable film such as, for example, a plastic film, a metal film, a finely closed cloth, a thin board and granules, powder or flakes, with or without a binder, a thin rubber board, paper or the like.

When a smooth or decorated patterned surface of the molded product is desirable, a film or thin board which has a smooth or patterned surface, such as, for example, a plastic film or a thin rubber board, may be used, and it is possible to prepare a cement panel coated with a plastic film by separating a molded product along with the plastic film as a decorated film. It is also possible to retain the plastic film upon the surface of the molded product during the separating operation, and to peel off the plastic film at the time of use or during the processing operation so as to properly transfer or operate the same without damaging the smooth or patterned surface.

Within other applications, colored sand, for decoration, may be used as the shield layer, and a slurry of cementitious material is charged, set and separated so as to obtain a molded product covered with the colored sand, and it is also possible to separate a molded product covered with cloth, paper or other surface layer. However, when it is unnecessary to retain the shield layer upon the surface of the molded product for use thereof, it is preferable to use a plastic film with good workability and moldability.

The permeable sheet can contain particles, such as, for example, colored sand and a binder, and can be asbestos paper, glass cloth, other cloth, paper or porous plastic film, and the like. When the sheet is prepared by means of a dewatering method, such as, for example, for asbestos slate, glass fiber-reinforced cement, or the like, he filler material such as, for example, sand is maintained under reduced pressure conditions and the water of the slurry of the charged cementitious material is drawn through the porous holes of the permeable sheet and into the sand, whereby the set of the cementitious material is accelerated. Within such case, air is conducted into the filler material within the mold through means of the permeable sheet as the shield layer, and accordingly, it is necessary to use a suction pump having a high capacity, and it is preferable to provide uniform reduced pressure conditions by disposing a plurality of filters, as backing type filters, in a plurality of places.

The filler materials utilized within the present invention can be grains, powder, pellets flakes, or other configurations wich are air permeable when charged into the mold. Typical filler materials include sand and powder, crushed grains or hollow particles made of metal, glass or plastic, and wooden powder, wooden fibers, vermiculite, vermiculite balloon, artificial light aggregates, and the like. These materials can be mixed or can be filled in a plurality of layers, and it is possible to use fine particles as a layer near the surface, and to also mix magnetic particles therewithin so as to fix the layer under reduced pressure conditions as well as magnetic attraction conditions.

It is also possible to use a backing type filter which has good air permeability but which does not pass filler material, or to dispose discharge pipes having filter members therein within the filler material, or still further to dispose a filter within the back or side of the mold so as to suck air through the filter and cause a reduced pressure to be present within the filler material. Likewise, it is also possible to mix or dispose hollow materials or a box within the filler material so as to decrease the weight thereof within the mold.

Referring now to the drawings, and more particularly to FIGS. 1–4 thereof, one embodiment of the method of preparation of the mold used in conjunction with the present invention will now be described. A master model 1 made of, for example, wood, metal, gypsum, or other suitable material is covered with a thermoplastic film 2 which is heat-shaped, and it is possible to obtain a shaped plastic film which has precisely the same shape as that of the master model 1 by forming a multitude of porous holes, which have an average diameter of preferably less than 2 mm, so as to extend to the surface of the master model, or by using a porous master model, and applying suction through such holes so as to heat-shape the plastic film. The shield layer is not limited to the plastic film and can be any one of the above-mentioned materials. It is possible to coat the surface of the master model by spraying or coating a plastisole so as to form a plastic film and various methods for forming the film can be employed, as well as the aforenoted methods. It is also possible to apply a releasing agent to the master model or film so as to easily detach or separate the same, and it is likewise possible to apply a coating of coloring agent or other sprayed material which can be transferred onto the plastic film 2.

Figure 2:
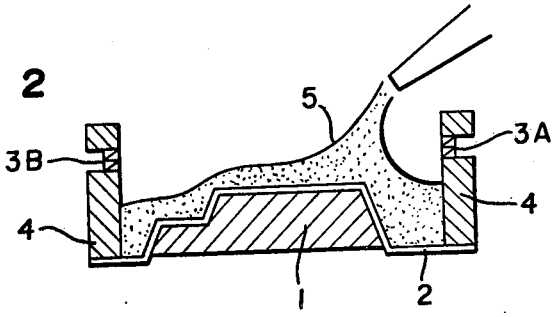

With reference to FIG. 2, there is shown a frame 4 which is equipped with filters 3A and 3B disposed around the master model 1 coated with the film 2 and a filler material 5, such as, for example, sand is charged thereinto. The filters 3A and 3B can be cloth, honeycomb, net or other filterable material which does not pass the filler material, but does pass air therethrough.

Figure 3:
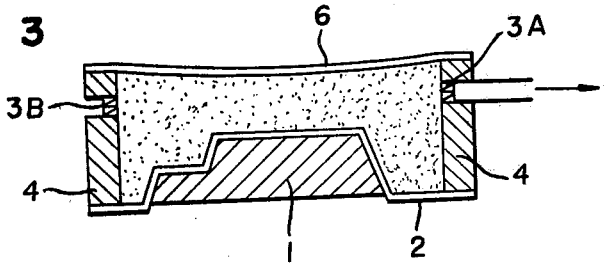

As shown within FIG. 3, an impermeable film, such as, for example, a plastic film 6 is disposed upon the filler material and the latter is fixed within a frame under a reduced pressure by means of suction applied through the filters 3A and 3B by means of a suction pump. Within FIG. 3, the suction through the filter 3A is clearly shown, and the suction through the filter 3B is similarly made, although the filter can be sealed if desirable.

Figure 4:
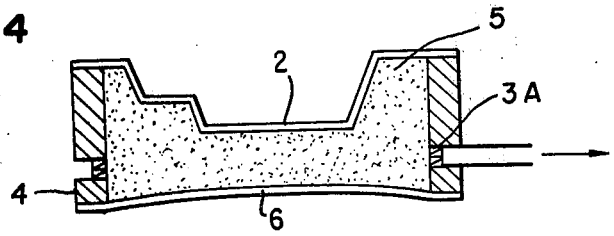

Within FIG. 4, the mold of FIG. 3 has been turned upside down, and the master model 1 has been removed so as to prepare the mold for use in accordance with the present invention. The filler material 5 is maintained in a fixed condition under a reduced pressure, however, it is not always necessary to continue the suction through means of filters. Nevertheless, it is preferable to continue the suction so as to maintain a reduced pressure as the pressure of the filler material within the frame is gradually increased to atmosphereic pressure because of the undesired incomplete adhesion between the film 2 or film 6 and the frame 4 or other connecting part.

As stated in connection with the embodiment of FIG. 1, when a multitude of fine holes are formed within the master model 1 and the master model is maintained under a reduced pressure during the shaping operation of the film 2 and the fixing operation of the filler material, it is possible to maintain the shape of the film 2 so as to correspond to that of the master model 1 and it is also possible to prevent deformation of the film normally caused by subjecting the filler material to the reduced pressure.

When the master model 1 is removed, the master model 1 can be easily separated from the film 2 by feeding compressed air through the fine holes, and when a releasing agent is coated upon the film 2, or upon the master model 1 before charging the filler matrial as shown within FIG. 2, the removal of the molded product from the master model can be easily carried out.

Figure 5:
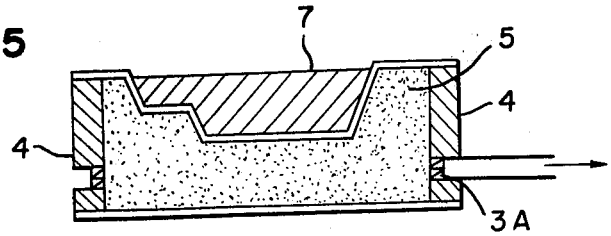
FIG. 5 is a cross-sectional view illustrating one embodiment of a method of molding a cementitious material according to the present invention.
Figure 6:
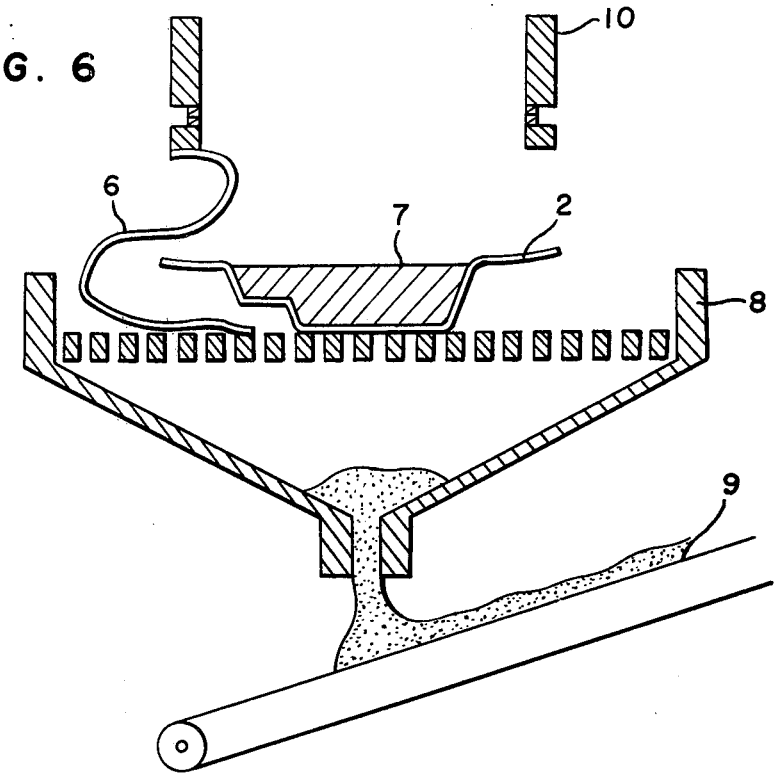
FIG. 6 is a cross-sectional view illustrating one embodiment of a method of separating a molded product from the mold.

FIGS. 5 and 6 show one embodiment of apparatus for practicing the method of molding a cementitious material by utilizing the mold prepared by means of the method illustrated within FIGS. 1–4 in accordance with the present invention. Within FIG. 5, a slurry 7 of cementititous material such as, for example, a mixture of portland cement, sand and 5% wt. of chopped glass fiber strands is charged into the mold of FIG. 4. The filler material 5 is maintained under reduced pressure by means of suction applied through means of filter 3A, and when an air permeable film, such as, for example, an air permeable plastic film, is utilized as the shield layer, water from the slurry of the cementitious material is sucked into the filler material at a predetermined rate, whereby setting of the cementitious material can be smoothly attained. The method is thus especially effective as a dewatering method, and the cementitious material will set within the next step.

In the case of heat curing, the temperature and the shield layer are preferably predetermined depending upon the condition of the final molded product such that the shield layer does not remain or become adhered to the surface of the product, and the reduced pressure within the filler material is released when the cementitious material is set so as not to cause deformation thereof. This condition is shown within FIG. 6, wherein the molded product 7 with the film 2 upon the surface thereof, remains upon the hopper 8. The filler material is discharged from the bottom of the hopper and is returned to the filler supply system so as to be re-used as charging the filler material as shown within FIG. 2, by means of a conveyer 9. It is to be noted that when a permeable film is utilized, it is preferable to reuse it after a washing and/or drying step of the filler material.

Within FIG. 6, the molded product has been removed from the frame, however, when the molded product extends to the upper portion 10 of the frame 4, the molded product remains upon the frame, however, the film 6 at the bottom thereof, and the filler material 5 have fallen into the hopper 8. When the shape of the molded product is not overly complex, it is possible to remove the molded product without the occurrence of a drop in the film 6 and the filler material 5 by simply reducing the pressure.

Certain applications of the mold utilized within the present invention will now be illustrated. Within FIG. 7, a permeable cylindrical filter 11 is disposed within the filler material in lieu of employing filters at both sides of the frame, and the suction is maintained through means of a pipe, not shown. In this case, the shape of the tubular filter is varied depending upon the shape of the mold, and consequently, the filler material is uniformly fixed at all positions whereby the mold is tightly maintained. Within the figure, although the filler material seems to be separated, it is actually continuous except for the area wherein the tubular filter is disposed, such being disclosed in an exaggerated condition. The tubular filter can be any filter having an inner hollow part, such as, for example, of a cylindrical, rectangular or elliptical tubular or other configuration, although the surface of the filter should have a filtering property.

Figure 7:
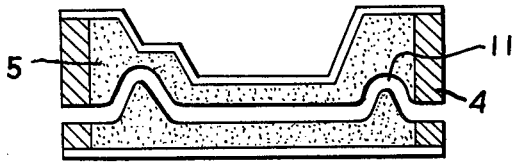
FIGS. 7–9 are cross-sectional views illustrating other embodiments of a method of molding a cementitious material according to the present invention.
Figure 8:
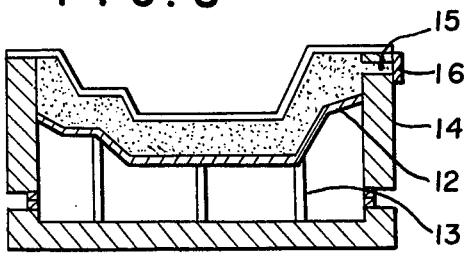

The embodiment of FIG. 8 has a similar effect as that of FIG. 7, and within FIG. 8, a backing mold 12, having an air permeability property, is supported by means of ribs 13, whereby the filler material is uniformly maintained in a fixed configuration. In this case, the impermeable film at the bottom thereof cannot be used, and accordingly, apertures 15 for filling the material, and the shield part 16, are formed within the frame 14 so as to charge the filler material into the mold from the side surface of the frame.

When a flexible tubular filter is utilized, it is possible to use the filter for differently configured molds, and if the configuration of the master model is quite different, it is necessary to change the backing mold of FIG. 8, however, it is possible to use the same without modification in the case of small changes or variations. It also is to be noted that the amount of filler material used can be small and when heavy filler material, such as, for example, sand is used, the weight can be advantageously decreased.

Figure 9:
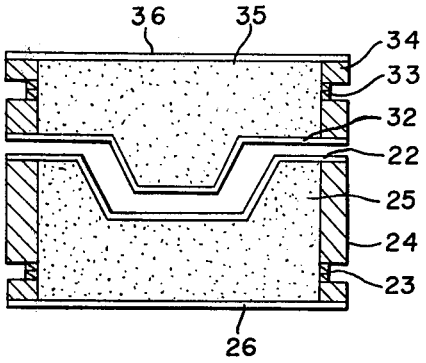

Turning now to FIG. 9, there is shown a molding apparatus which comprises a convex mold and a concave mold, the concave mold including a plastic film 22, filling material 25, a frame 24 having a filter 23 disposed therearound, and a film 26 at the bottom thereof. The concave mold is disposed relative to the convex mold with a predetermined gap therebetween and the convex mold is seen to comprise a plastic film 32, filler material 35, and a frame 34 having a filter 33 disposed therearound and a film 36 disposed thereon. A slurry of cementitious material is charged into the gap defined between the molds so as to be set whereupon the molded product is subsequently removed from either of the concave or convex molds or from both of the concave and convex molds by means of a one-step operation similiar to that shown within FIG. 6.

When the slurry is a cementitious material having a glass-fiber-reinforced cement which has low fluidity, it is possible to separate the same from one of the molds and to retain the same within the other mold in the setting condition. It is also possible to use molds prepared by repeating the steps illustrated within FIGS. 1–4, to charge the filler material such as, for example, sand within each mold to set the filler material under a reduced pressure, and subsequently, to release the reduced pressure condition of the filler material within the lower mold so as to remove the upper mold along with the shield layer, such as, for example a plastic film so as to obtain a convex or concave mold.

In this case, even though a filler material having a high density, such as, for example, sand is utilized within a mold having the configuration of FIG. 9, it is possible to maintain the gap defined between the molds so as to have a value of several tens of cms. When a suitable filter, such as, for example, a tubular filter is disposed in a suitable position relative to the filler material, or when a back filter is used, it is possible to maintain the filler material layer so as to have a thickness greater than 1m. When a diminishable master model, such as for example, those which are diminished by means of heating, or those which become liquified or dissolved with a solvent, such as, for example, those made of foamed resin or of a material having a low melting point is used, it is possible to easily produce a mold having a complex configuration. The molded product can be easily obtained merely by releasing the reduced pressure of the filler materail after the cementitious material, charged into the mold, has set. It is thus unnecessary to prepare separable molds, and accordingly, a mold having a relatively complex configuration can be easily obtained.

Figure 10:
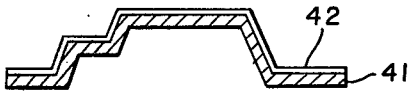
FIGS. 10–13 are cross-sectional views illustrating another embodiment for preparing a mold in accordance with the present invention.

FIGS. 10–13 illustrate a method of preparation of a mold similar to that shown within FIGS. 1–4, and it is seen that FIG. 10 shows the master model 41 coated with a thermoplastic film 42 by means of heat-shaping. The characteristic features, such as, for example, the formation of the fine holes which extend to the surface of the master model, the use of a porous master model or other means for forming a sheet or the use of a releasing or coloring agent, are similar to those characteristic of FIG. 1, and the method of FIG. 11 corresponds to that of FIG. 2. A frame 44, provided with filters 43A and 43B, is disposed about the periphery of the master model 41 coated with the film 42, and the filler material 45, such as for example, sand is charged into the frame, the filters being the same as those of FIG. 2.

Figure 12:
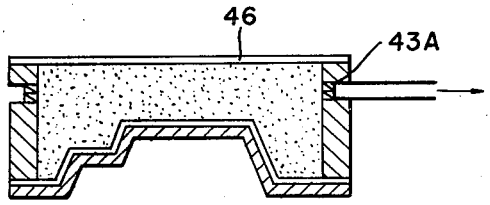

The apparatus of FIG. 12 corresponds to that of FIG. 3, and an impermeable film such as, for example, a plastic film 46 is disposed upon the filler material which is maintained under reduced pressure conditions developed by suction applied through means of the filter 43A, whereby the filler material is fixed or set. In this case, the filter 43B at the left side of the apparatus is also provided with suction, or alternatively, is sealed so as to be impermeable. The apparatus of FIG. 13 corresponds to that of FIG. 4, for preparing the mold utilized within the present invention, and the operation and effects of the reduced pressure is also similar to that of FIG. 4.

Figure 13:
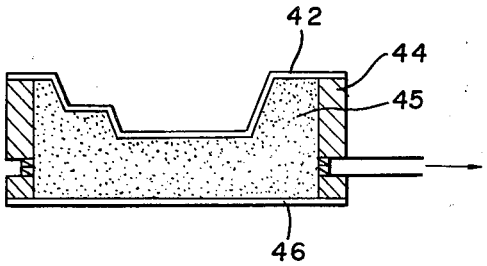
Figure 14:
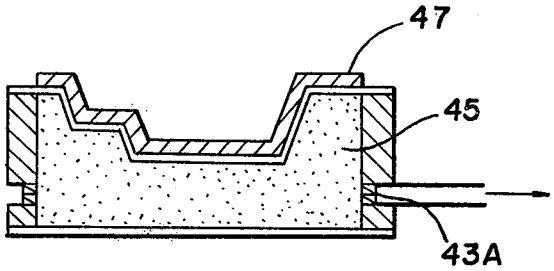
FIGS. 14–18 are cross-sectional views illustrating another embodiment of a method of molding a cementitious material according to the present invention.

Referring now to FIGS. 14–18, another embodiment of a method of molding a cementitious material 47 is illustrated, and within FIG. 14, the cementitious material, such as, for example, a slurry comprising portland cement, sand and 5% wt. of chopped glass fiber strands and water, is charged into the mold, by spraying the same upon the mold of FIG. 13. The filler material 45 is maintained under reduced pressure conditions by means of suction applied through means of a filter 43A, and as seen within FIG. 15, a second frame 48 for setting of the materials is disposed upon the frame of the mold. A second filler material 49 is charged into the second frame 48 and as seen within FIG. 16, an impermeable film such as, for example, a plastic film 50 is applied over the second filler material so as to cover the same, the second filler material 49 being fixed or set under reduced pressure conditions by means of suction applied through a filter 51.

It is possible to provide a second shield layer, if desirable, similar to that of the first shield layer 2, however, when a second shield layer is not provided, or an air permeable sheet is utilized as the second shield layer, water from the cementitious material 47 is drawn into the second filler material 49 so as to accelerate the setting of the cementitious material. In addition, when the time for charging the filler material, for applying the reduced pressure condition, or for charging the filler material after modifying the thickness and surface condition of the cementitious material 47, is controlled, the setting condition of the cementitious material 47 can be maintained to a desirable degree whereby it is possible to prepare a molded product of cementitious material having superior characteristics in comparison with a molded product prepared by using an air permeable sheet as the shield layer 42.

When it is not necessary to provide the molded product with a smooth surface, it is preferable not to use a second shield sheet, and as it is not necessary to provide the shield sheet upon the cementitious material 47 so as to cover the same, the second filler material 49 can be easily charged into the apparatus even though a molded product having a complex configuration is being prepared, and in addition, the productivity is substantially improved while shortening the operation time thereof. In accordance with the method of the present invention then, when a slurry of cementitious material having high viscosity is utilized, a shell type product can be easily prepared by spraying the slurry.

However, when it is necessary to provide a product of constant thickness, or to mold the opposite surface, that is, the upper surface of the cementitious material of FIG. 14 into a special configuration, it is necessary to arrange the apparatus after the slurry of cementitious material 47 has been charged. Accordingly, the method of the present invention is suitable for preapring a molded product in the case that the configuration and surface condition of the opposite surface thereof are not required to be precise.

When the cementitious material 47 is hardened or set to the degree that no deformation occurs, the molding mold and hardening mold are separated so as to obtain a molded product of cementitious material. As shown within FIG. 17, when the hardening mold remains, the molding mold is separated therefrom during the step of setting of the cementitious material 47 to such a degree that there is no fluidity of the same. The cementitious material 47 is retained upon the hardening mold until no deformation occurs, and in this case, the molding mold can be repeatedly used for a short period of time so as to improve the productivity of the process. The hardening mold may comprise an internal heating element for heat curing of the material, and it is also possible to cure the cementitious material 47 upon the hardening mold within a heated chamber.

Figure 18:
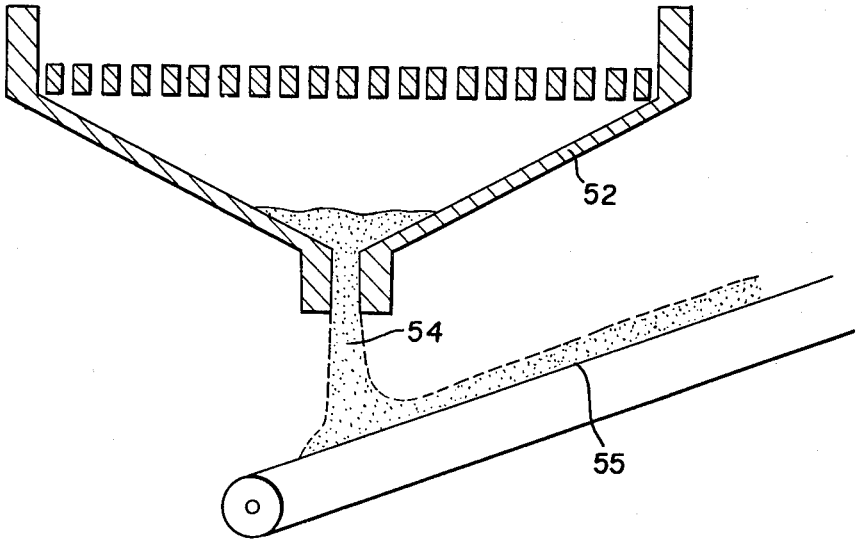

Within FIG. 18, the separated mold is shown and the reduced pressure characteristic of the filler material has been released. When the filler material has a high water content, compressed air may be applied, and the filler material is able to be discharged from the bottom of the hopper 52 while the cementitious molded product 53 remains upon the setting frame 48. The filler material 54 discharged from the bottom of hopper 52 is recycled so as to be recharged again as filler material, as seen within FIG. 18 by means of conveyer 55, and when the filler material 45 is the same as that of filler material 49, all of the filler material discharged when the reduced pressure is released can be returned for recharging the filler material into the mold as seen within FIG. 11 or FIG. 15.

Figure 11:
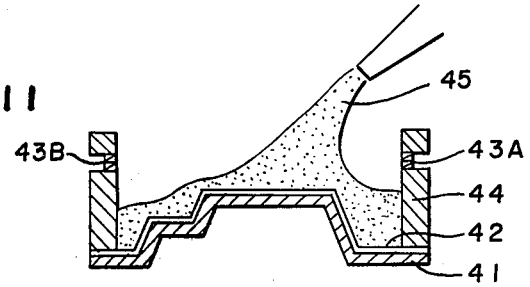
Figure 15:
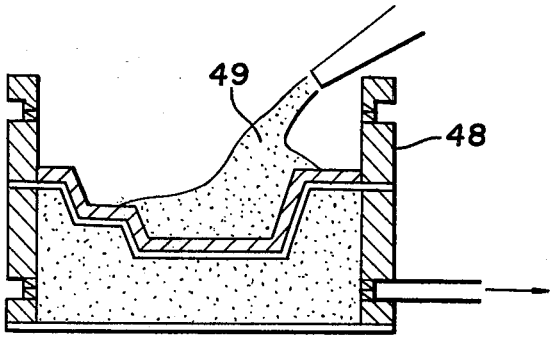
Figure 16:
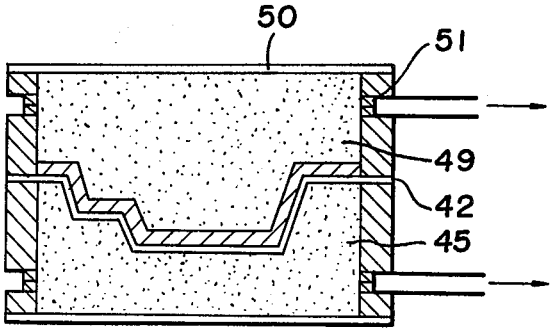
Figure 17:
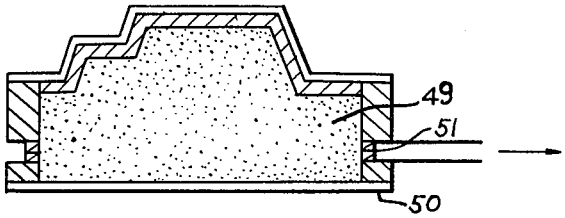
Figure 17:
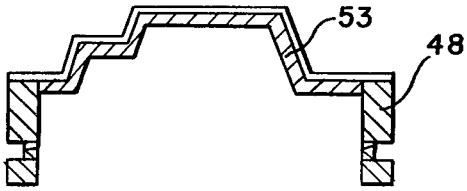

The filler material discharged as shown within FIG. 18 can be returned for recharging the filler material, as seen within FIG. 11 or FIG. 15, however, when the filler material contains water, due to the use of suction and in the case of the absence of the shield layer or the use of the air permeable sheet, the filler material is preferably reused after washing and/or drying the same. Within FIG. 18, the molded product remains upon the mold, however, it is possible for the same to drop down upon the hopper depending upon the configuration of the molded product. Furthermore, it is also possible to separate the product by disposing the same, as shown within FIG. 17, upon a table, releasing the reduced pressure, and grasping the molded product.

When a second shield layer is not used, or an air permeable second shield sheet is used, a coloring agent, or a decorating agent, such as, for example, paint and/or a spray tile may be applied upon the first shield layer and the cementitious material may then be charged thereon. The hardening mold is then, in turn, disposed upon the material and a reduced pressure applied whereby a portion of the coloring agent or decorating agent is drawn into the cementitious material so as to be firmly bonded therein. Within this embodiment, the shield layer upon which the coloring agent or decorating agent is applied is preferably an impermeable film, such as, for example, a plastic film.

Within the application process, a decorating agent, such as, for example, stone powder, lithin powder, wooden powder or other powdery material may be used, if desirable, with a tackifier and the surface of the cementitious molded product may be scraped or scratched so as to obtain a cementitious molded product having a rough decorated surface. In addition, the preparation of the molding mold as shown within FIGS. 7–9, can also be applied to the molding mold and/or the hardening mold within this embodiment.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States is:

1. A method of molding cementitious material comprising:

charging wet cementitious material into a molding mold;

disposing a first mold frame about the wet cementitious material;

charging filler material under air permeable conditions directly onto the wet cementitious material;

disposing a shield layer which is impermeable over the filler material;

fixing the filler material under reduced pressure caused by suction applied through a source of suction to form a hardening mold;

retaining the cementitious material on the hardening mold; and permitting the cementitious material is set upon the hardening mold.

2. The method according to claim 1 further comprising:

detaching the molding mold after the cementitious material has set so as not to deform the cementitious material; and permitting the molded cementitious material to harden on the hardening mold.

3. The method according to claim 1 wherein the molded cementitious material is detached from the hardening mold by applying compressed air to the filler material.

4. The method according to claim 1 wherein the filler material is moist sand.

5. The method according to claim 1 wherein the cementitious material charged into the molding mold is a slurry of water and water settable inorganic material selected from the group of portland cement, slag cement, alumina cement, Roman cement, natural cement, hydraulic lime, magnesia cement, lime, gypsum and mixtures thereof with or without an aggregate or a fibrous reinforced material.

6. The method according to claim 1 wherein the cementitious material contains glass fiber.

7. The method according to claim 1 wherein said first mold frame has one or more open faces covered with an air impermeable film.

8. The method according to claim 1 further comprising prior to said step of disposing said first mold frame about the cementitious material;

disposing a first shield layer over a master model;

disposing a second mold frame about the master model;

disposing filler material within the second mold frame;

disposing a second shield layer which is impermeable over the filler material;

operatively connecting the filler material to a source of suction through means of a filter to fix the filler material under a reduced pressure condition to form the molding mold;

turning the mold frame, the master model, the filler material and the first and second shield layers upside down; and, removing the master model.

9. The method according to claim 8 wherein the molded cementitious material is detached from either the molding and/or the hardening mold by applying compressed air to the filler material and/or the additional filler material.

10. A method of molding a wet cementitious material comprising:

charging a slurry of wet cementitious material into a molding mold;

placing a frame, equipped with a filter connected to a suction pump around the molding mold;

charging a filler material directly onto the wet cementitious material;

disposing a shield layer which is impermeable to cover the filler material;

fixing the filler material within the frame under a reduced pressure condition caused by suction through the filter to form a hardening mold;

detaching the molded cementitious material from the molding mold and retaining the molded cementitious material with respect to the hardening mold; and discontinuing the reduced pressure within the frame after the mold cementitious material has set.

11. A method of molding a cementitious material comprising:

placing a first frame, equipped with a first filter connected to a suction pump, around a master model having a first shield layer thereon;

charging first filler material into the first frame to cover the first filter under permeable conditions;

disposing a second shield layer which is impermeable to cover the first filler material;

turning upside down the master model, the first and second shield layers, the first frame and the first filler material;

fixing the first filler material under a reduced pressure condition caused by suction through the first filter to form a first mold;

removing the master model;

charging a slurry of cementitious material into the first mold;

placing a second frame, equipped with a second filter connected to the suction pump, upon the first frame;

charging a second filler material onto the cementitious material;

disposing a third shield layer which is impermeable to cover the second filler material;

fixing the second filler material within the second frame under a reduced pressure condition caused by suction through the second filter to form a second mold;

detaching the molded cementitious material from the first mold and retaining the molded cementitious material with respect to the second mold; and discontinuing the reduced pressure within the second frame after the molded cementitious material has set.

* * * * *